US009225110B2

(12) United States Patent
Huang

(10) Patent No.: US 9,225,110 B2
(45) Date of Patent: Dec. 29, 2015

(54) FASTENING DEVICE OF PLUG-SOCKET COMBINATION

(71) Applicant: Rong Feng Industrial Co. Ltd., Nantou (TW)

(72) Inventor: Yung Ming Huang, Nantou (TW)

(73) Assignee: Rong Feng Industrial Co. Ltd., Nantou (TW)

( * ) Notice: Subject to any disclaimer, the term of this patent is extended or adjusted under 35 U.S.C. 154(b) by 0 days.

(21) Appl. No.: 14/540,862

(22) Filed: Nov. 13, 2014

(65) Prior Publication Data

US 2015/0280362 A1 Oct. 1, 2015

(30) Foreign Application Priority Data

Mar. 28, 2014 (TW) ..... 103205393 U

(51) Int. Cl.
*H01R 13/627* (2006.01)

(52) U.S. Cl.
CPC ..... *H01R 13/6272* (2013.01)

(58) Field of Classification Search
CPC ..... H01R 13/6278; H01R 13/6271; H01R 13/6275
USPC ..... 439/354, 358
See application file for complete search history.

(56) References Cited

U.S. PATENT DOCUMENTS 7,841,888 B2 * 11/2010 Xia ..... H01R 13/6395 439/354
7,967,629 B1 * 6/2011 Liu ..... H01R 24/20 439/354

* cited by examiner

*Primary Examiner* — Tulsidas C Patel
*Assistant Examiner* — Marcus Harcum
(74) *Attorney, Agent, or Firm* — Andrew C. Cheng

(57) ABSTRACT

A fastening device of a plug-socket combination includes a plug structure and a socket structure. The socket structure has a side wall in which an insertion slot is formed. A plastic fastening plate includes a slit-defined barb formed on each of two sides of a lower end thereof. When the plastic fastening plate is inserted into the insertion slot, the slit-defined barbs are allowed to elastically expand to respectively engage pawls formed at a lower end of the slot. The plastic fastening plate has a free end on which a plastic pawl is formed. The plug projection of the plug structure, when jointed, through insertion, to the insertion recess of the socket structure, smoothly passes over the plastic pawl to allow the plastic pawl to spring into and thus fix the positioning cavity at the time when the positioning cavity and the plastic pawl are in alignment with each other.

2 Claims, 7 Drawing Sheets

FASTENING DEVICE OF PLUG-SOCKET COMBINATION

BACKGROUND OF THE INVENTION

1. Field of the Invention

The present invention relates to the field of plug and socket, and in particular to an improved fastening device of a plug-socket combination, in which a fastening plate is integrally formed with a plastic pawl through injection molding so as to provide a large engagement area, have an enhanced strength, and be not easily separated.

2. The Related Arts

One of the most influencing events for an industrial processing machine is unexpected interruption of power supply. The interruption of power supply may result in lowering of product yield rate and also affect the schedule of the processing operation and what is even worse is causing loss of the original processing or operation parameters. Further, power failure or interruption of power supply may lead to severe loss and damage. Conventional power plugs and sockets are often connected through plugging the blades of a plug into the slots of a socket to establish electrical connection. However, such a simple way of connection may cause ready separation of the blades of the plug from the slots of the socket due to for example stretching or pulling of the electrical cables to which the plug and the socket are mount or pulling of the plug and socket themselves. The consequence of such separation is the interruption of power supply.

To handle such a problem, as shown in FIG. 1, a fastening device of a plug-socket combination was proposed by the present inventor, including a plug structure 1 and a socket structure 2, wherein the socket structure 2 has a side wall, in which a slot 3, which is in a form for receiving a plate, is formed. An open recess 4, which faces outwards, is formed in the side wall to be at a lower end of the plate receiving slot 3. A fastening plate 5 has a lower end on which a spring plate 6 that extends upward in a slanting and outward-diverging manner. When the fastening plate 5 is inserted into the plate-receiving slot 3, the spring plate 6 is allowed to expand outward to engage and thus be positioned against a lower edge of the open recess 4. An elastic pawl 7 is formed on a free end of the fastening plate 5 so that when blades of the plug structure 1 are plugged into slots of the socket structure 2, the plug structure that comprises a positioning cavity 8 is allowed to smoothly pass through the elastic pawl 7 to have the positioning cavity 8 aligning with the elastic pawl 7 whereby the elastic pawl 7 may be driven by the elasticity to get into and thus fix the positioning cavity 8 so as to prevent the plug structure 1 from separating from the socket structure 2 and securely maintaining the connection between the plug structure 1 and the socket structure 2, without being separated due to being pulled by external forces, to ensure normal power supply therethrough. However, although it is possible to prevent separation caused by pulling or stretching, the fastening plate 5 is made of metal so that the fastening plate 5 and the pawl 7 have a thickness that is small, providing the elastic pawl 7 with insufficient strength. Thus, further improvements are necessary.

Thus, the present invention aims to provide a novel structure that overcomes the above-discussed problems and issues.

SUMMARY OF THE INVENTION

The primary object of the present invention is to provide an improved fastening device of a plug-socket combination, which comprises a fastening plate that is made through plastic injection and comprises a plastic pawl integrally formed therewith so that the plastic pawl is allowed to catch a relatively large area, has an improved strength, and is not easily to detach.

To achieve the above object, the present invention provides an improved fastening device of a plug-socket combination, which comprises: a plug structure and a socket structure. The socket structure has a side wall in which an insertion slot is formed. A plastic fastening plate comprises a slit-defined barb formed on each of two sides of a lower end thereof. When the plastic fastening plate is inserted into the insertion slot, the slit-defined barbs are allowed to elastically expand to respectively engage pawls formed at a lower end of the slot to achieve positioning. The plastic fastening plate has a free end on which a plastic pawl is formed, whereby the plug projection of the plug structure, when jointed, through insertion, to the insertion recess of the socket structure, smoothly passes over the plastic pawl to allow the plastic pawl to spring into and thus fix the positioning cavity at the time when the positioning cavity and the plastic pawl are in alignment with each other so as to prevent the plug structure from moving backward to separate from the socket structure, unless the release tab is depressed to allow the plastic pawl to separate from the positioning cavity. The plastic pawl that is made of a plastic material provides a large engagement area, has an enhanced strength, and is not easily separated.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
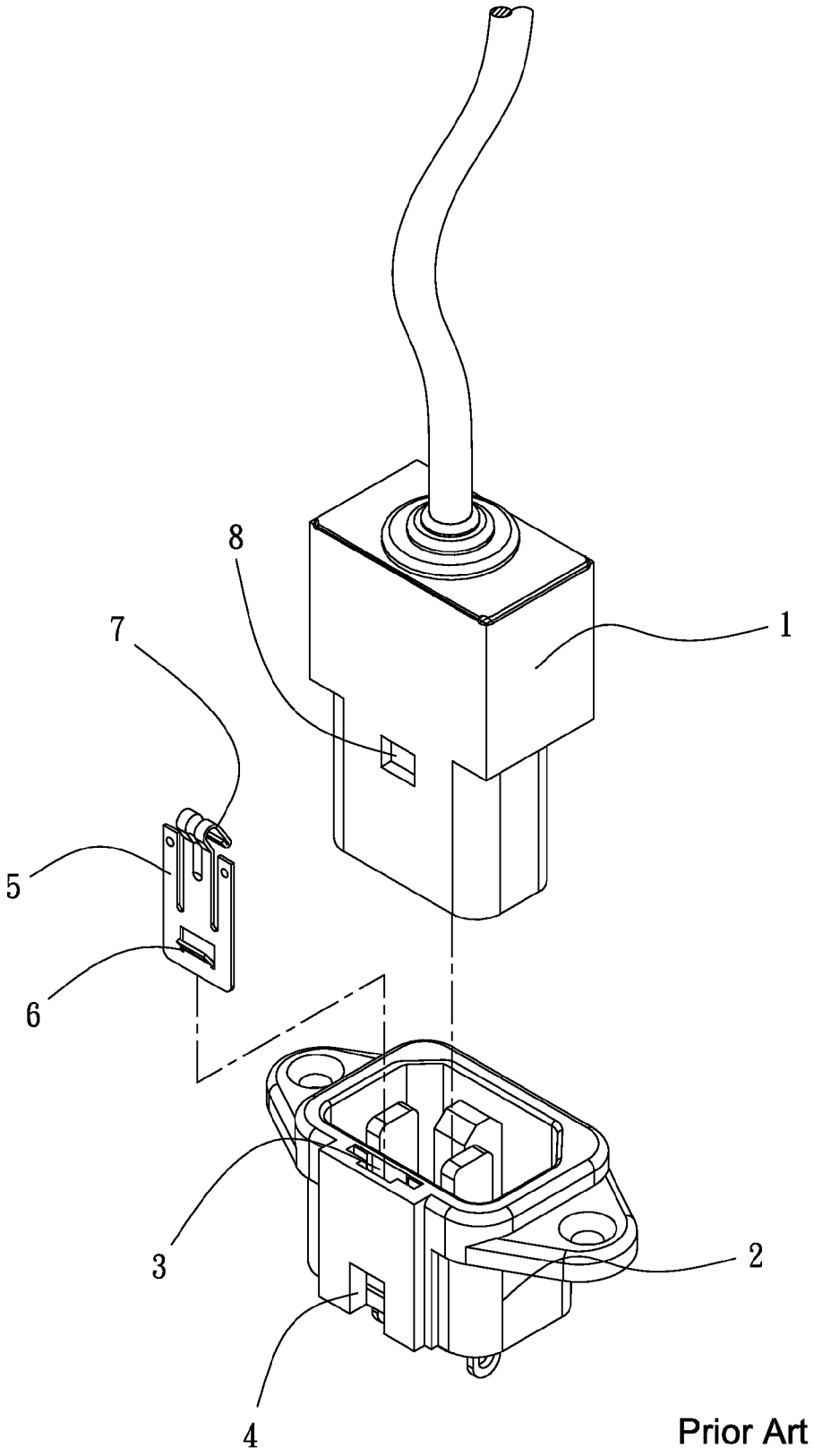
Prior Art Fig 1
FIG. 1 is an exploded view of a known fastening device of a plug-socket combination.

The present invention provides an improved fastening device of a plug-socket combination. A detailed description will be given to discuss the structural features and other advantages and objects of the present invention with reference to the accompanying drawings.

Referring to FIGS. 2-6, the present invention provides an improved fastening device of a plug-socket combination, which can be a power inlet plug-socket combination, comprises:

a plug structure 10, wherein the plug structure 10 comprises an extended connection cable 11, the plug structure 10 having a front end that forms a plug projection 12, the plug structure 10 having a side wall 13 in which a positioning cavity 14 is formed;

a socket structure 20, wherein the socket structure 20 comprises an insertion recess 21, the insertion recess 21 comprising a plurality of terminal pins 22 arranged therein in such a way that the plurality of terminal pins 22 is respectively insertable into a plurality of pin holes 15 (shown in FIG. 5) formed in the plug structure 10 to establish electrical connection therebetween for electrical conduction, the socket structure 20 having a side wall 24 in which an insertion slot 23 is formed, the insertion slot 23 having two opposite sides in each of which a guide rail 231 is formed; and a plastic fastening plate 30, wherein the plastic fastening plate 30 has two opposite sides each forming a rail channel 31, the plastic fastening plate 30 comprising a slit-defined barb 32 formed on each of two sides of a lower end of a front surface thereof, the slit-defined barbs 32 being elastically deformable during the plastic fastening plate 30 is being inserted into the insertion slot 23 and being allowed to elastically expand to respectively engage two pawls 25 formed at two opposite sides of a lower end of the insertion slot to achieve positioning, the slit-defined barbs 32 each having an expansion/retraction slit 321 that receives and is thus engageable with a slit engagement block 26 that projects from the socket structure 20 to prevent elastic contraction and thus detachment of the slit-defined barb 32, the plastic fastening plate 30 comprising a plastic pawl 33 formed at an upper end of a rear surface thereof, two slits 34 being formed in the plate respectively at opposite sides of the plastic pawl 33, the plastic pawl 33 comprising a release tab 35 provided on and projecting out from an upper end thereof, whereby the plug projection 12 of the plug structure 10, when jointed, through insertion, to the insertion recess 21 of the socket structure 20, smoothly passes over the plastic pawl 33 to allow the plastic pawl 33 to spring into and thus fix the positioning cavity 14 at the time when the positioning cavity 14 and the plastic pawl 33 are in alignment with each other so as to prevent the plug structure 10 from moving backward to separate from the socket structure 20, unless the release tab 35 is depressed to allow the plastic pawl 33 to separate from the positioning cavity 14, so that the connection between the plug structure 10 and the socket structure 20 can be kept to ensure continuous supply of electricity therethrough and to provide protection against interruption of power supply resulting from separation caused by stretching and pulling, where the plastic fastening plate 30 is integrally formed with the plastic pawl 33 and the plastic pawl 33 provides a large engagement area, has an enhanced strength, and is not easily separated.

Figure 2:
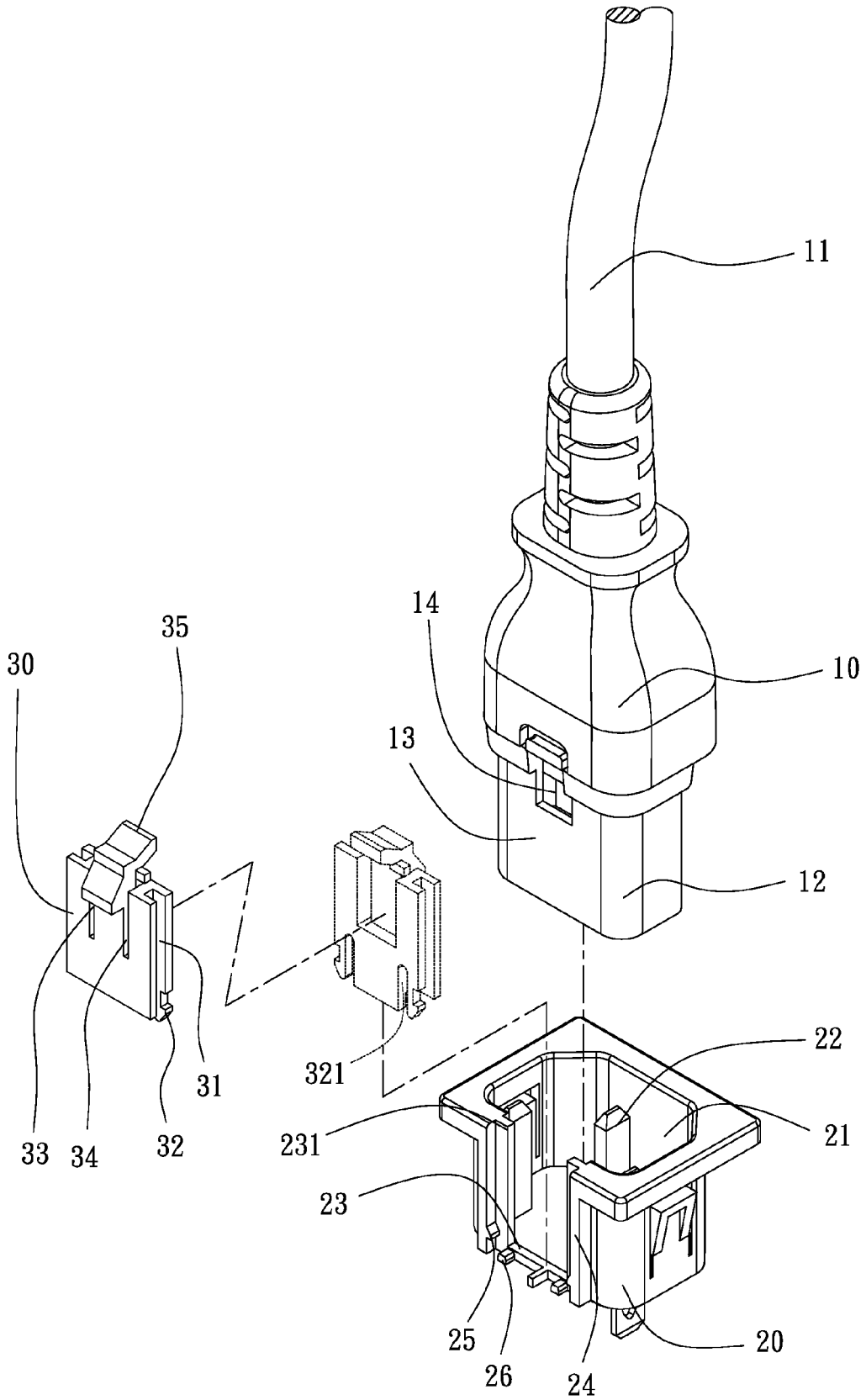
FIG. 2 is an exploded view of an embodiment of the present invention.
Figure 3:
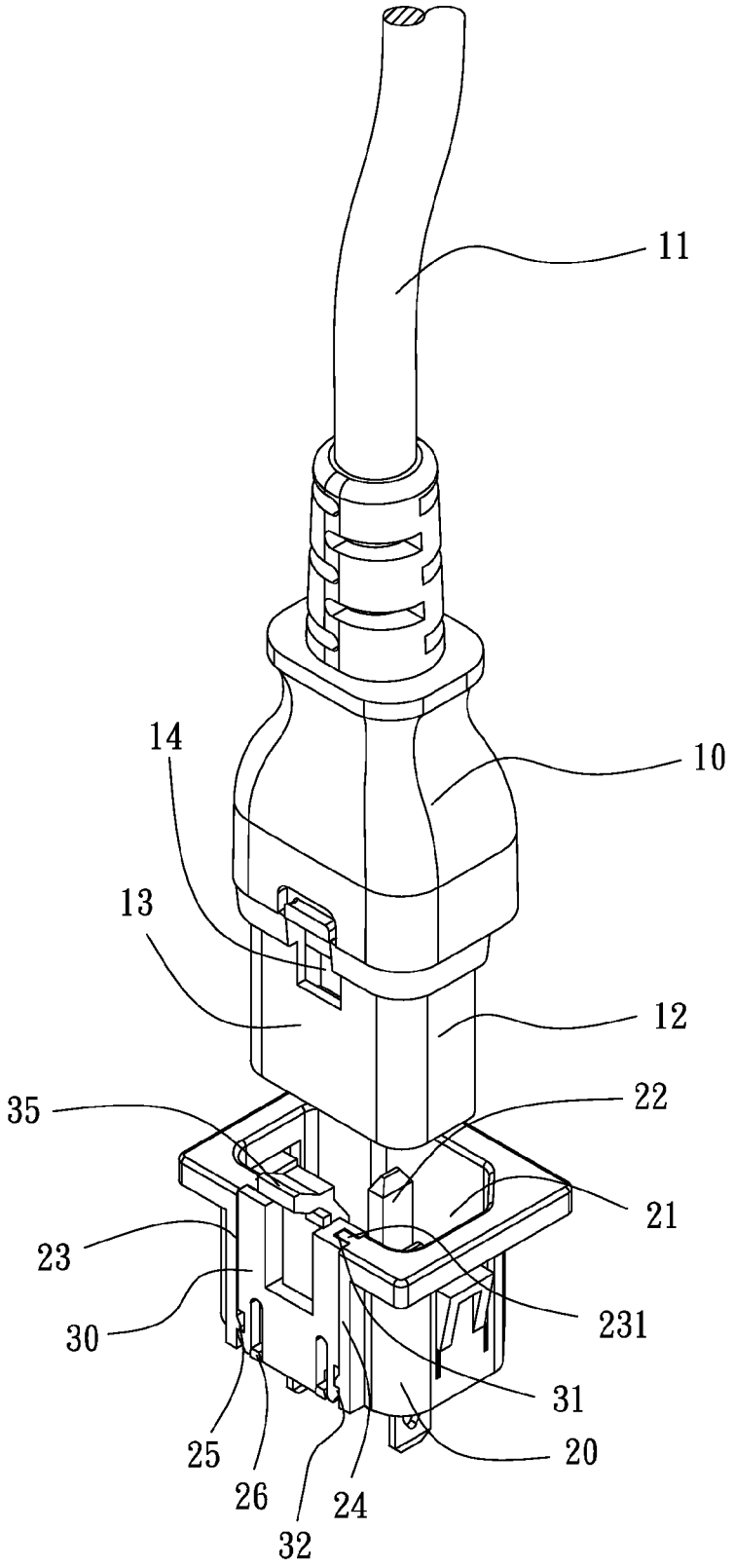
FIG. 3 is a perspective view of the embodiment of the present invention showing a condition that a plug and a socket are separated from each other.
Figure 4:
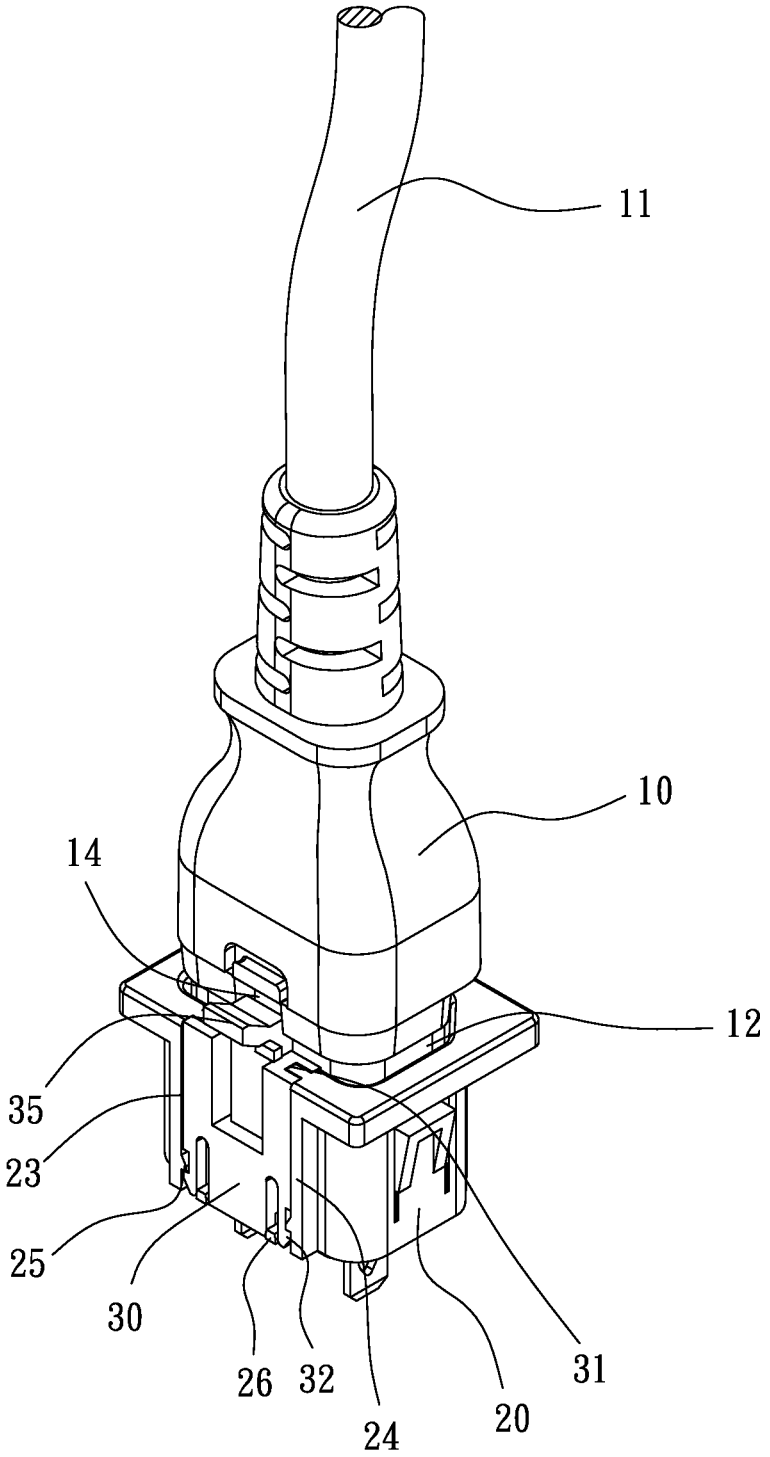
FIG. 4 is a perspective view of the embodiment of the present invention showing a condition that the plug and the socket are plugged together.
Figure 5:
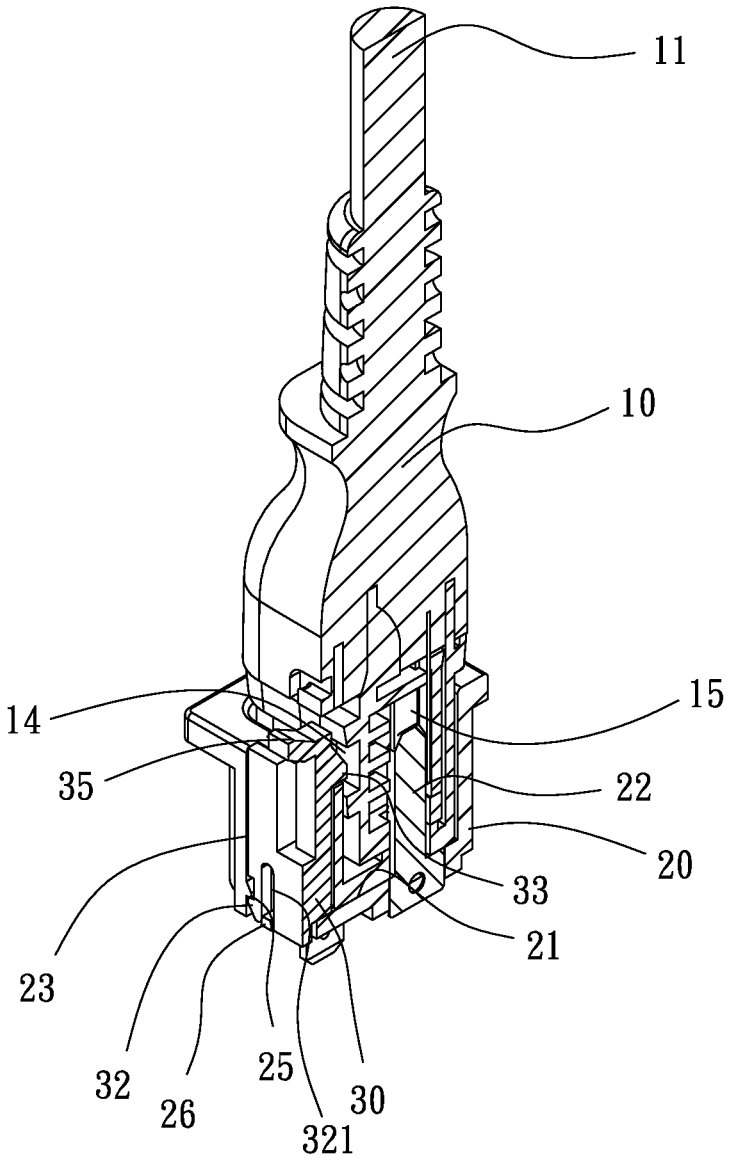
FIG. 5 is a perspective view, in a broken form, showing the embodiment of the present invention in the condition that the plug and the socket are plugged together.

Referring to FIGS. 2-6, these drawings respectively illustrate a condition where the plug structure 10 and the socket structure 20 are separated (as shown in FIG. 2), a condition where the plug projection 12 of the plug structure 10 is being inserted into the insertion recess 21 of the socket structure 20 (as shown in FIG. 3), wherein the insertion direction allows it to push the plastic pawl 33 outward so as to allow the plug projection 12 to smoothly pass over the plastic pawl 33 to move into and combine with the insertion recess 21 (as shown in FIG. 5), and when the positioning cavity 14 and the plastic pawl 33 are in alignment with each other, the plastic pawl 33 is allowed to spring into and thus fix the positioning cavity 14 to prevent the plug structure 10 from moving backward to separate from the socket structure 20, so that the connection between the plug structure 10 and the socket structure 20 can be kept to ensure continuous supply of electricity therethrough and to provide protection against interruption of power supply resulting from separation caused by stretching and pulling, where the plastic fastening plate 30 that is made of a plastic material provides a large engagement area, has an enhanced strength, and is not easily separated.

Figure 6:
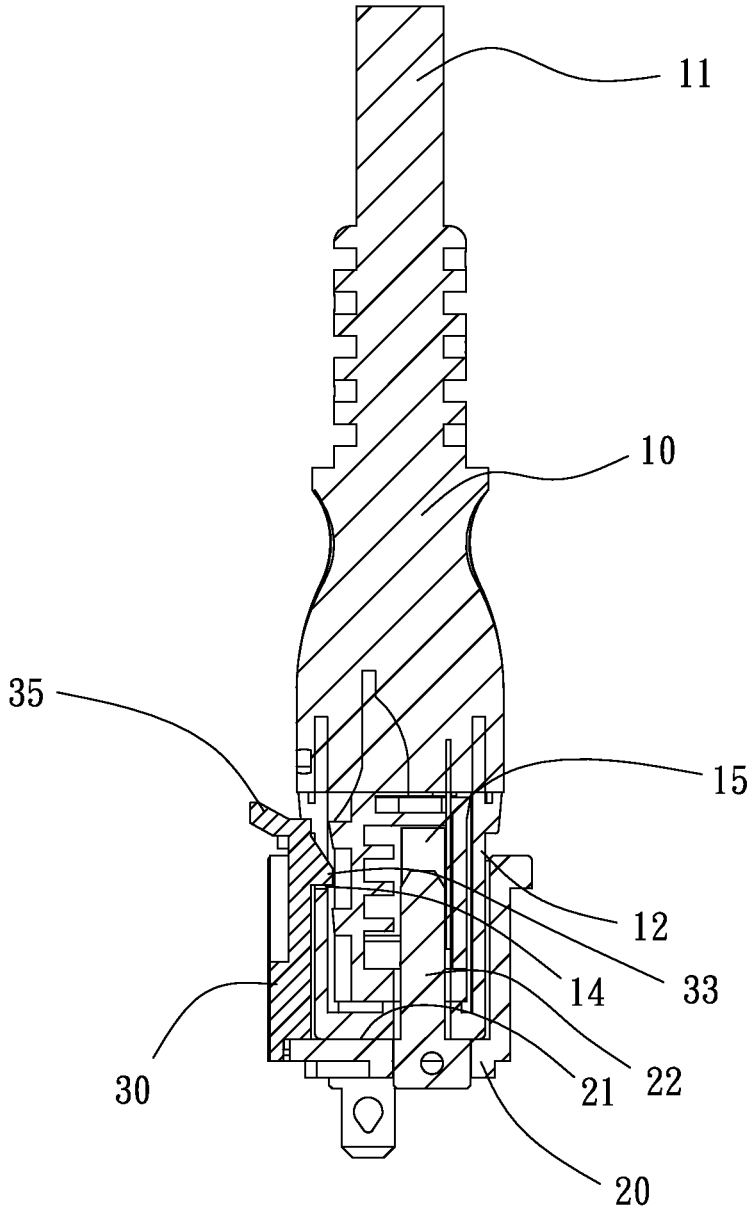
FIG. 6 is a cross-sectional view of the embodiment of the present invention in the condition that the plug and the socket are plugged together.

Referring to FIGS. 5 and 6, to combine the plug structure 10 and the socket structure 20, the plug projection 12 is inserted into the insertion recess 21 to allow the positioning cavity 14 to align with the plastic pawl 33 so as to allow the plastic pawl 33 to spring into and fix the positioning cavity 14, whereby unless the extended connection cable 11 is accidentally kicked or the extended connection cable 11 is pulled or stretched unintentionally, the plug structure 10 or the socket structure 20 does not get separated due to the stretching or pulling so that the plug structure 10 is prevented from moving backward to separate from the socket structure 20 and the connection between the plug structure 10 and the socket structure 20 can be kept to ensure continuous supply of electricity therethrough and to provide protection against interruption of power supply resulting from separation caused by stretching and pulling.

Figure 7:
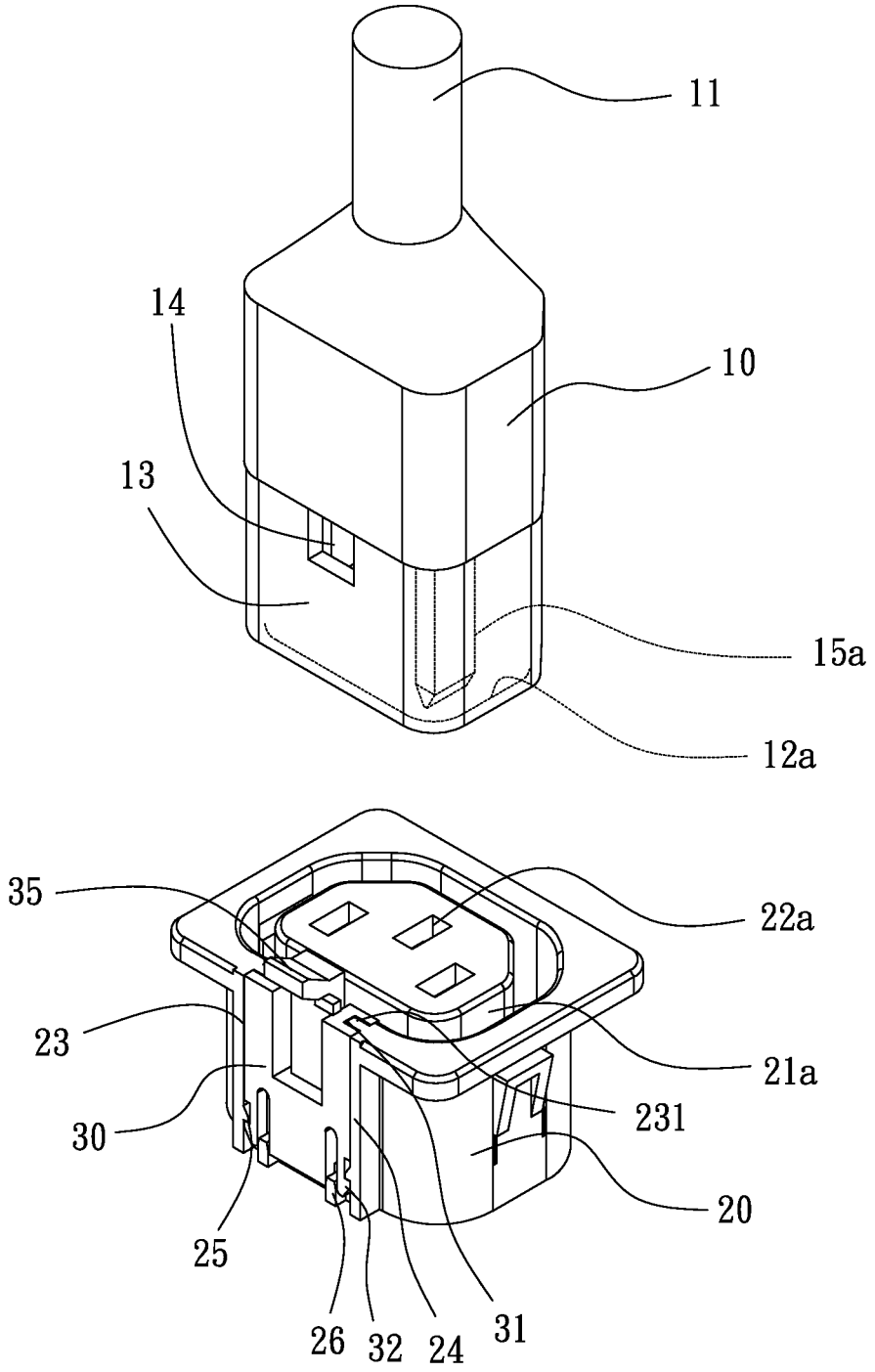
FIG. 7 is a schematic view illustrating another embodiment of the present invention in a condition that a plug structure and a socket structure are separated from each other.

Referring to FIG. 7, an improved fastening device of a plug-socket combination, comprises:

a power outlet plug-socket combination, which is composed of a plug structure 10 and a socket structure 20, wherein the plug structure 10 comprises an extended connection cable 11, the plug structure 10 having a front end forming a plug recess 12*a*, the plug structure 10 having a side wall 13 forming a positioning cavity 14; and the socket structure 20 comprises an insertion projection 21*a*, the insertion projection 21*a* comprising a plurality of pin holes 22*a* formed therein, the plurality of pin holes 22*a* being arranged to receive a plurality of terminal pins 15*a* of the plug structure 10 to insert therein to establish electrical connection therebetween for electrical conduction, the socket structure 20 having a side wall 24 in which an insertion slot 23 is formed; and a plastic fastening plate 30, wherein the plastic fastening plate 30 has two opposite sides each forming a rail channel 31, the insertion slot 23 of the socket structure 20 having two sides each forming a guide rail 231 for being received in to the rail channel 31, the plastic fastening plate 30 comprising a slit-defined barb 32 formed on each of two sides of a lower end of a front surface thereof, the slit-defined barbs 32 being elastically deformable during the plastic fastening plate 30 is being inserted into the insertion slot 23 and being allowed to elastically expand to respectively engage two pawls 25 formed at two opposite sides of a lower end of the insertion slot to achieve positioning, the slit-defined barbs 32 each having an expansion/retraction slit 321 that receives and is thus engageable with a slit engagement block 26 that projects from the socket structure 20 to prevent elastic contraction and thus detachment of the slit-defined barb 32, the plastic fastening plate 30 comprising a plastic pawl 33 formed at an upper end of a rear surface thereof, two slits 34 being formed in the plate respectively at opposite sides of the plastic pawl 33, the plastic pawl 33 comprising a release tab 35 provided on and projecting out from an upper end thereof, whereby the plug recess 12*a* of the plug structure 10, when jointed, through insertion, to the insertion projection 21 a of the socket structure 20, smoothly passes over the plastic pawl 33 to allow the plastic pawl 33 to spring into and thus fix the positioning cavity 14 at the time when the positioning cavity 14 and the plastic pawl 33 are in alignment with each other so as to prevent the plug structure 10 from moving backward to separate from the socket structure 20, unless the release tab 35 is depressed to allow the plastic pawl 33 to separate from the positioning cavity 14.

It is understood from the above description that the present invention provides a fastening device of a plug-socket combination, in which a fastening plate is integrally formed with a plastic pawl through injection molding so as to provide a large engagement area, have an enhanced strength, and be not easily separated.

The power inlet plug-socket combination is commonly used in general machines and computers, while the power outlet plug-socket combination is commonly used in power extension cords.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A fastening device of a plug-socket combination, comprising:

a power inlet plug-socket combination, which is composed of a plug structure and a socket structure, the plug structure comprising an extended connection cable, the plug structure having a front end that forms a plug projection, the plug structure having a side wall in which a positioning cavity is formed, the socket structure comprising an insertion recess, the insertion recess comprising a plurality of terminal pins arranged therein in such a way that the plurality of terminal pins is respectively insertable into a plurality of pin holes formed in the plug structure to establish electrical connection therebetween for electrical conduction, the socket structure having a side wall in which an insertion slot is formed; and characterized in that:

a plastic fastening plate, wherein the plastic fastening plate has two opposite sides each forming a rail channel, the insertion slot of the socket structure having two opposite sides in each of which a guide rail is formed for being received in the respective rail channel, the plastic fastening plate comprising a slit-defined barb formed on each of two sides of a lower end of a front surface thereof, the slit-defined barbs being elastically deformable during the plastic fastening plate is being inserted into the insertion slot and being allowed to elastically expand to respectively engage two pawls formed at two opposite sides of a lower end of the insertion slot to achieve positioning, the slit-defined barbs each having an expansion/retraction slit that receives and is thus engageable with a slit engagement block that projects from the socket structure to prevent elastic contraction and thus detachment of the slit-defined barb, the plastic fastening plate comprising a plastic pawl formed at an upper end of a rear surface thereof, two slits being formed in the plate respectively at opposite sides of the plastic pawl, the plastic pawl comprising a release tab provided on and projecting out from an upper end thereof, whereby the plug projection of the plug structure, when jointed, through insertion, to the insertion recess of the socket structure, smoothly passes over the plastic pawl to allow the plastic pawl to spring into and thus fix the positioning cavity at the time when the positioning cavity and the plastic pawl are in alignment with each other so as to prevent the plug structure from moving backward to separate from the socket structure, unless the release tab is depressed to allow the plastic pawl to separate from the positioning cavity.

2. A fastening device of a plug-socket combination, comprising:

a power outlet plug-socket combination, which is composed of a plug structure and a socket structure, wherein the plug structure comprises an extended connection cable, the plug structure having a front end forming a plug recess, the plug structure having a side wall forming a positioning cavity; and the socket structure comprises an insertion projection, the insertion projection comprising a plurality of pin holes formed therein, the plurality of pin holes being arranged to receive a plurality of terminal pins of the plug structure to insert therein to establish electrical connection therebetween for electrical conduction, the socket structure having a side wall in which an insertion slot is formed; characterized in that:

a plastic fastening plate, wherein the plastic fastening plate has two opposite sides each forming a rail channel, the insertion slot of the socket structure having two sides each forming a guide rail for being received in to the rail channel, the plastic fastening plate comprising a slit-defined barb formed on each of two sides of a lower end of a front surface thereof, the slit-defined barbs being elastically deformable during the plastic fastening plate is being inserted into the insertion slot and being allowed to elastically expand to respectively engage two pawls formed at two opposite sides of a lower end of the insertion slot to achieve positioning, the slit-defined barbs each having an expansion/retraction slit that receives and is thus engageable with a slit engagement block that projects from the socket structure to prevent elastic contraction and thus detachment of the slit-defined barb, the plastic fastening plate comprising a plastic pawl formed at an upper end of a rear surface thereof, two slits being formed in the plate respectively at opposite sides of the plastic pawl, the plastic pawl comprising a release tab provided on and projecting out from an upper end thereof, whereby the plug recess of the plug structure, when jointed, through insertion, to the insertion projection of the socket structure, smoothly passes over the plastic pawl to allow the plastic pawl to spring into and thus fix the positioning cavity at the time when the positioning cavity and the plastic pawl are in alignment with each other so as to prevent the plug structure from moving backward to separate from the socket structure, unless the release tab is depressed to allow the plastic pawl to separate from the positioning cavity.

* * * * *